US005865652A

United States Patent [19]

Stuter et al.

[11] Patent Number: 5,865,652

[45] Date of Patent: Feb. 2, 1999

[54] KEYED INTERCONNECTION FOR DISTINGUISHING INPUT CONNECTIONS AND OUTPUT CONNECTIONS

[75] Inventors: Barbra Stuter, Lincoln; Thomas G. Bower, Auburn; Lisa Pinio, Rocklin, all of Calif.

[73] Assignee: Hewlett-Packard Company, Palo Alto, Calif.

[21] Appl. No.: 837,528

[22] Filed: Apr. 21, 1997

[51] Int. Cl.[6] ..... H01R 13/64

[52] U.S. Cl. ..... 439/680; 29/747

[58] Field of Search ..... 439/677, 678, 439/679, 680, 681, 607, 533; 29/592.1, 825, 747

[56] References Cited

U.S. PATENT DOCUMENTS 4,368,942 1/1983 Mathe et al. ..... 439/680

FOREIGN PATENT DOCUMENTS 405217629 8/1993 Japan ..... 439/247

*Primary Examiner*—Neil Abrams
*Assistant Examiner*—Brian J. Biggi

[57] ABSTRACT

A cabling connection system provides cabling connection for an equipment box. A unit input connector is placed on the equipment box. A unit output connector is also placed on the equipment box. The unit input connector and the unit output connector are of identical shape and gender. A cover plate is placed on the equipment box over the unit input connector and the unit output connector. The cover plate has a first opening which allows access to the unit input connector and has a second opening which allows access to the unit output connector. The first opening is a different shape than the second opening. This results in the first opening acting as a first keying feature for the unit input connector and the second opening acting as a second keying feature for the unit output connector.

16 Claims, 3 Drawing Sheets

KEYED INTERCONNECTION FOR DISTINGUISHING INPUT CONNECTIONS AND OUTPUT CONNECTIONS

BACKGROUND

The present invention concerns interconnecting equipment together and pertains particularly to using keyed interconnection sockets in order to distinguish between input connections and output connections.

In various applications, it is necessary to connect electronic equipment together. Generally cables with standard connections are used to provide the connections.

In many applications, a single equipment box may include both an input and an output. In such a system it is often important to make a clear distinction between inputs and outputs. For example, when connecting together stackable hubs of a network together, it is important that an input from one hub be connected to an output of another hub. If two hub inputs are connected together or two hub outputs are connected together, the network will fail to operate properly.

Typically, when it is necessary to make a clear distinction between an input on an equipment box and an output on an equipment box, the unit input connector and the unit output connector on the equipment box are of a different gender. That is, the unit input connector on the equipment box is a male and the unit output connector on the equipment box is a female, or alternately, the unit input connector on the equipment box is a female and the unit output connector on the equipment box is a male. A cable used to connect such equipment boxes together will likewise have a male connector at one end of the cable and a female connector at the other end of the cable.

Typically, the male connectors will include pins and the female connectors will include sockets. These pin and socket interconnects can be prone to damage especially when cabling them up. If a customer attempts to plug the male connector of the cable into the male connector of the equipment box, damage can occur to the pins in the male connector of the cable and the male connector of the equipment box.

SUMMARY OF THE INVENTION

In accordance with the preferred embodiment of the present invention, a cabling connection system provides cabling connection for an equipment box. A unit input connector is placed on the equipment box. A unit output connector is also placed on the equipment box. The unit input connector and the unit output connector are of identical shape and gender. A cover plate is placed on the equipment box over the unit input connector and the unit output connector. The cover plate has a first opening which allows access to the unit input connector and has a second opening which allows access to the unit output connector. The first opening is a different shape than the second opening. This results in the first opening acting as a first keying feature for the unit input connector and the second opening acting as a second keying feature for the unit output connector.

For example, the first keying feature includes a first plurality of slots in a first formation around the unit input connector. The second keying feature likewise includes a second plurality of slots in a second formation around the unit output connector. In one preferred embodiment of the present invention, the second formation is a mirror image of the first formation. For example, the unit input connector is a female microleaf style connector, and the unit output connector is a female microleaf style connector.

A cable used for connection to the equipment box includes, for example a cable end connector overmold at each end of the cable. A first cable end connector overmold at a first end of the cable has a first cable end connector and a first cable keying feature molded over the first cable end connector. The first cable keying feature allows the first cable end connector to be connected to the unit input connector, but prevents the first cable end connector from being connected to the unit output connector.

A second cable end connector overmold at a second end of the cable has a second cable end connector and a second cable keying feature molded over the second cable end connector. The second cable end connector is identical in shape to the first cable end connector. The second cable keying feature allows the second cable end connector to be connected to the unit output connector, but prevents the second cable end connector from being connected to the unit input connector.

For example, the first cable keying feature includes a first plurality of protrusions in a first formation around the first cable end connector. Likewise, the second cable keying feature includes a second plurality of protrusions in a second formation around the second cable end connector. In one embodiment of the present invention, the second formation is a mirror image of the first formation. For example, the first cable end connector is a male microleaf style connector, and the second cable end connector is a male microleaf style connector.

The present invention provides for a straightforward way to use identical connectors for both unit input connectors and unit output connectors on an equipment box, while also preventing erroneous connections of two inputs together or two outputs together.

DESCRIPTION OF THE PREFERRED EMBODIMENT

Figure 1:
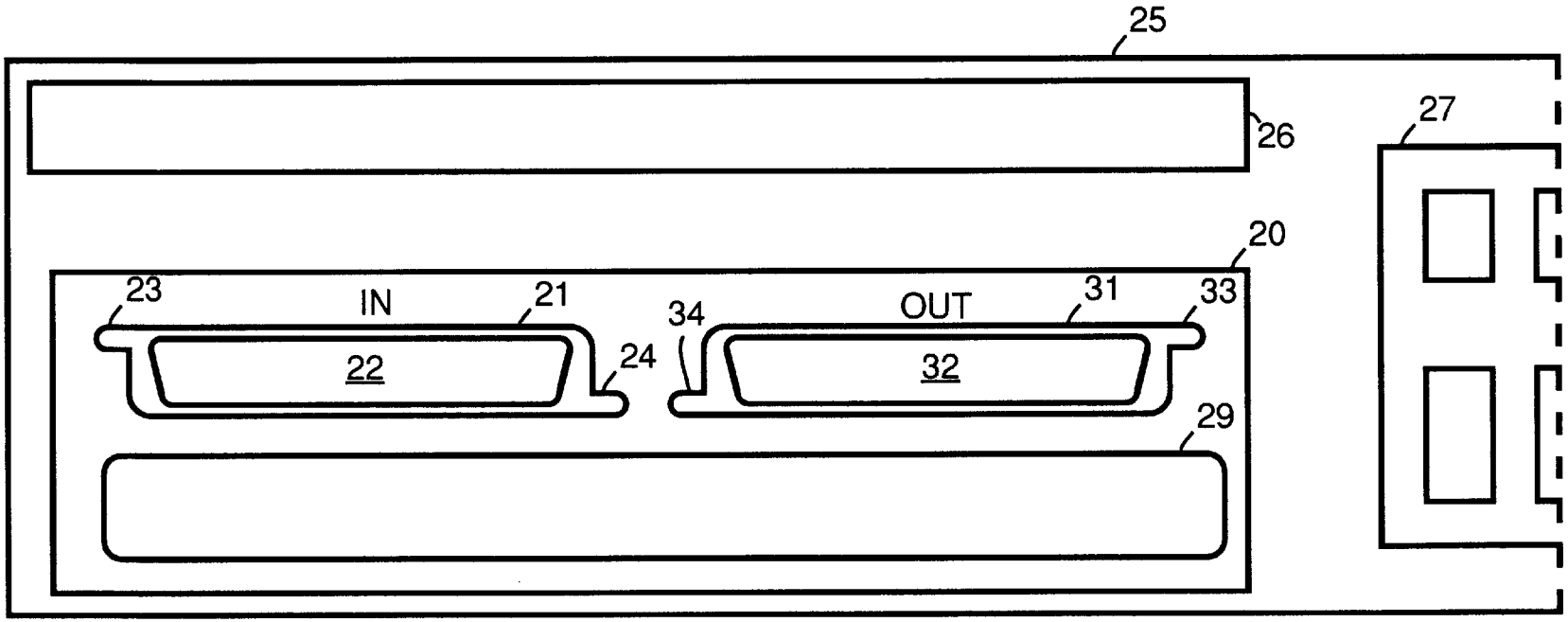
FIG. 1 shows an equipment box for a stackable hub which includes a cover plate which has a keyed unit input connector and a keyed unit output connector in accordance with a preferred embodiment of the present invention.

FIG. 1 shows an equipment box 25. Equipment box 25 has a panel 26, a panel 27, and perhaps other panels not shown in FIG. 1. For example, equipment box 25 houses a stackable hub or some other equipment that requires connection by cables.

Equipment box 25 also includes a cover plate 20. Cover plate 20 covers a unit input connector 22 and a unit output connector 32. Cover plate 20 is, for example, a single piece molded cover plate. Alternatively, cover plate 20, could be for example, in two separate pieces, so long as one portion of cover plate 20 covers unit input connector 22 and one portion of cover plate 20 covers unit output connector 32.

For example, unit input connector 22 is a female microleaf style connector. Unit output connector 32 is also, for example, a female microleaf style connector. Unit output connector 22 is identical in shape and connection capability to unit input connector 22.

In order to allow for distinguishing between unit input connector 22 and unit output connector 32, an opening 21 in cover plate 20 allowing access to unit input connector 22 includes a slot 23 and a slot 24. Slot 23 and slot 24 act together to provide a keying function for unit input connector 22, as further described below. Likewise, an opening 31 in cover plate 20 allowing access to unit output connector 32 includes a slot 33 and a slot 34. Slot 33 and slot 34 act together to provide a keying function for unit output connector 32, as further described below. A remaining control panel 29 includes various other features accessible through cover plate 20. For example remaining control panel includes status lights and/or additional connectors.

Figure 2:
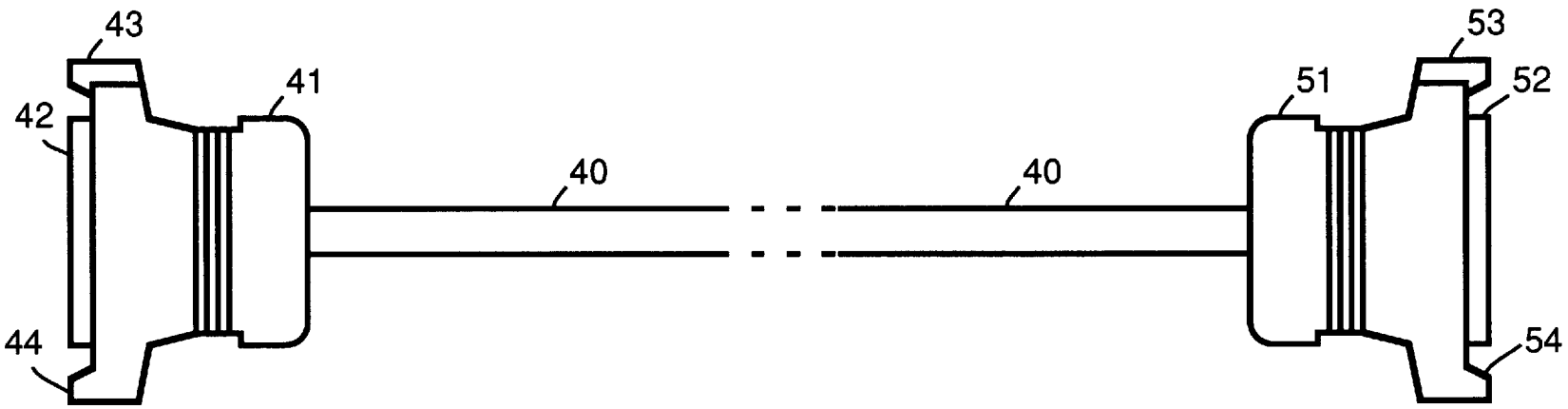
FIG. 2 shows a side view of an interconnection cable which includes a keyed input cable end connector and a keyed output cable end connector in accordance with a preferred embodiment of the present invention.

FIG. 2 shows a cable 40 which can be used for connection to unit input connector 22 and/or unit output connector 23. A cable end connector overmold 41 of cable 40, includes a cable end connector 42. For example, cable end connector 42 is a male microleaf style connector. The over-molding around cable end connector 42 includes a protrusion 43 and a protrusion 44. Protrusion 43 and protrusion 44 act as keying features. When cable end connector overmold 41 is connected to unit input connector 22 (shown in FIG. 1), protrusion 43 fits in slot 23 and protrusion 44 fits in slot 24. This allows cable end connector 42 to be electrically connected to unit input connector 22.

However, because protrusion 43 and protrusion 44 are not keyed to fit within slot 34 and slot 33, it is impossible to electrically connect cable end connector 42 to output slot 32. Thus head 41 of cable 40 can only be connected to unit input connector 22 of equipment box 25 and cannot be connected to unit output connector 32 of equipment box 25.

A cable end connector overmold 51 of cable 40, includes a cable end connector 52. For example, cable end connector 52 is a male microleaf style connector. The over-molding around cable end connector 52 includes a protrusion 53 and a protrusion 54. Protrusion 53 and protrusion 54 act as keying features. When cable end connector overmold 51 is connected to unit output connector 32 (shown in FIG. 1), protrusion 53 fits in slot 33 and protrusion 54 fits in slot 34. This allows cable end connector 52 to be electrically connected to unit output connector 32.

However, because protrusion 53 and protrusion 54 are not keyed to fit within slot 24 and slot 23, it is impossible to electrically connect cable end connector 52 to output slot 22. Thus head 51 of cable 40 can only be connected to unit output connector 32 of equipment box 25 and cannot be connected to unit input connector 22 of equipment box 25.

Figure 3:
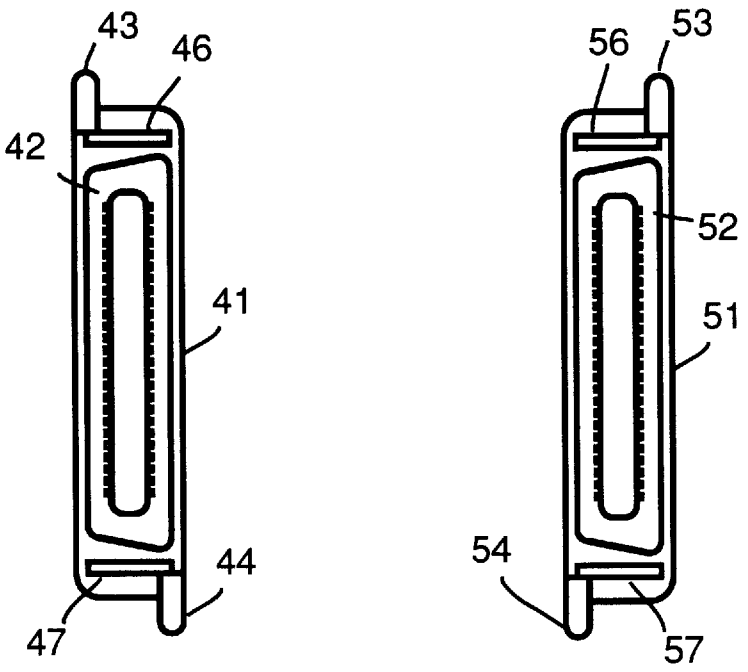
FIG. 3 shows a front view of the keyed input cable end connector and the keyed output cable end connector for the interconnection cable shown in FIG. 1 in accordance with a preferred embodiment of the present invention.

FIG. 3 shows a frontal view of cable end connector overmold 41 and of cable end connector overmold 51. In the frontal view of cable end connector overmold 41 the relationship of cable end connector 42, slot 43 and slot 44 are shown. A slot 46 and a slot 47 also may be included as part of head 41 and allow for latches in the cable.

In the frontal view of cable end connector overmold 51 the relationship of cable end connector 52, slot 53 and slot 54 are shown. A slot 56 and a slot 57 also may be included as part of head 51 and allow for latches in the cable.

As shown by each of FIG. 1, FIG. 2 and FIG. 3, the keying feature for input connections is a mirror image of the keying feature for output connections. That is, as shown in FIG. 1, slot 33 and slot 34 included as part of opening 31 around unit output connector 32 form a mirror image of slot 23 and slot 24 which are included as part of opening 21 around unit input connector 22. Likewise, as shown in FIG. 2 and FIG. 3, protrusion 53 and protrusion 54 in the molded cover plate around cable end connector 52 form a mirror image of protrusion 43 and protrusion 44 in the molded cover plate around cable end connector 42. This mirror image provides perceived symmetry to the user. However, the present invention may equally utilize various other keying features so long as the keying feature in the over-molding for the unit input connector varies from the keying feature in the over-molding for the unit output connector.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A method for providing cabling connection for an equipment box comprising the following steps:

(a) providing on the equipment box a unit input connector;

(b) providing on the equipment box a unit output connector, the unit input connector and the unit output connector being of identical shape and gender; and, (c) providing on the equipment box a cover plate placed on the equipment box over the unit input connector and the unit output connector, the cover plate having a first opening allowing access to the unit input connector and a second opening allowing access to the unit output connector;

wherein the first opening allowing access to the unit input connector is a different shape than the second opening allowing access to the unit output connector so that the first opening acts as a first keying feature for the unit input connector and the second opening acts as a second keying feature for the unit output connector.

2. A method as in claim 1 additionally comprising the following step:

(d) providing a cable for connection to the equipment box, including the following substeps:

(d.1) providing a first cable end connector overmold at a first end of the cable, the first cable end connector overmold having a first cable end connector and a first cable keying feature molded over the first cable end connector, the first cable keying feature allowing the first cable end connector to be connected to the unit input connector, but preventing the first cable end connector from being connected to the unit output connector, and (d.2) providing a second cable end connector overmold at a second end of the cable, the second cable end connector overmold having a second cable end connector and a second cable keying feature molded over the second cable end connector, the second cable end connector being identical in shape to the first cable end connector, the second cable keying feature allowing the second cable end connector to be connected to the unit output connector, but preventing the second cable end connector from being connected to the unit input connector.

3. A method as in claim 2 wherein:

in substep (d.1), the first cable keying feature includes a first plurality of protrusions in a first formation around the first cable end connector; and, in substep (d.2), the second cable keying feature includes a second plurality of protrusions in a second formation around the second cable end connector.

4. A method as in claim 3 wherein:

in substep (d.2) the second formation is a mirror image of the first formation.

5. A method as in claim 2 wherein:

in substep (d.1) the first cable end connector is a male microleaf style connector; and, in substep (d.2) the second cable end connector is a male microleaf style connector.

6. A method as in claim 1 wherein:

in step (c), the first keying feature includes a first plurality of slots in a first formation around the unit input connector, and the second keying feature includes a second plurality of slots in a second formation around the unit output connector.

7. A method as in claim 6 wherein:

in step (c) the second formation is a mirror image of the first formation.

8. A method as in claim 1 wherein:

in step (c) the unit input connector is a female microleaf style connector, and the unit output connector is a female microleaf style connector.

9. A cabling connection system for providing cabling connection for an equipment box comprising:

a unit input connector placed on the equipment box;

a unit output connector placed on the equipment box, the unit input connector and the unit output connector being of identical shape and gender; and, a cover plate on the equipment box over the unit input connector and the unit output connector, the cover plate having a first opening allowing access to the unit input connector and a second opening allowing access to the unit output connector;

wherein the first opening allowing access to the unit input connector is a first shape and the second opening allowing access to the unit output connector is a second shape, the second shape being a mirror image of the first shape so that the first opening acts as a first keying feature for the unit input connector and the second opening acts as a second keying feature for the unit output connector.

10. A cabling connection system as in claim 9 additionally comprising:

a cable for connection to the equipment box, the cable including:

a first cable end connector overmold at a first end of the cable, the first cable end connector overmold having a first cable end connector and a first cable keying feature molded over the first cable end connector, the first cable keying feature allowing the first cable end connector to be connected to the unit input connector, but preventing the first cable end connector from being connected to the unit output connector, and a second cable end connector overmold at a second end of the cable, the second cable end connector overmold having a second cable end connector and a second cable keying feature molded over the second cable end connector, the second cable end connector being identical in shape to the first cable end connector, the second cable keying feature allowing the second cable end connector to be connected to the unit output connector, but preventing the second cable end connector from being connected to the unit input connector.

11. A cabling connection system as in claim 10 wherein:

the first cable keying feature includes a first plurality of protrusions in a first formation around the first cable end connector; and, the second cable keying feature includes a second plurality of protrusions in a second formation around the second cable end connector.

12. A cabling connection system as in claim 11 wherein:

the second formation is a mirror image of the first formation.

13. A cabling connection system as in claim 10 wherein:

the first cable end connector is a male microleaf style connector; and, the second cable end connector is a male microleaf style connector.

14. A cabling connection system as in claim 9 wherein:

the first keying feature includes a first plurality of slots in a first formation around the unit input connector; and, the second keying feature includes a second plurality of slots in a second formation around the unit output connector.

15. A cabling connection system as in claim 14 wherein:

the second formation is a mirror image of the first formation.

16. A cabling connection system as in claim 9 wherein:

the unit input connector is a female microleaf style connector; and, the unit output connector is a female microleaf style connector.

* * * * *